US008904928B2

(12) United States Patent
Vogt et al.

(10) Patent No.: US 8,904,928 B2
(45) Date of Patent: Dec. 9, 2014

(54) PAD PRINTING MACHINE

(75) Inventors: Udo Vogt, Rottenburg (DE); Thomas Pfeifle, Huzenbach (DE)

(73) Assignee: ITW Morlock GmbH, Dornstetten (DE)

( * ) Notice: Subject to any disclaimer, the term of this patent is extended or adjusted under 35 U.S.C. 154(b) by 474 days.

(21) Appl. No.: 13/062,082

(22) PCT Filed: Aug. 7, 2009

(86) PCT No.: PCT/IB2009/053493

§ 371 (c)(1),
(2), (4) Date: Mar. 3, 2011

(87) PCT Pub. No.: WO2010/029449

PCT Pub. Date: Mar. 18, 2010

(65) Prior Publication Data

US 2011/0162546 A1 Jul. 7, 2011

(30) Foreign Application Priority Data

Sep. 9, 2008 (DE) ..... 10 2008 046 487

(51) Int. Cl.
*B41F 17/00* (2006.01)
*B41F 17/08* (2006.01)
*B41F 17/30* (2006.01)

(52) U.S. Cl.
CPC ..... *B41F 17/001* (2013.01)
USPC ..... 101/41; 101/163; 101/44

(58) Field of Classification Search
USPC ..... 101/41, 44, 163, 492, 493
See application file for complete search history.

(56) References Cited

U.S. PATENT DOCUMENTS

| | | | | |
|---|---|---|---|---|
| 2,002,698 | A | 5/1935 | Kruczek | |
| 4,738,198 | A | 4/1988 | Sillner | |
| 5,315,927 | A * | 5/1994 | Yeh | 101/35 |
| 7,658,146 | B2 | 2/2010 | Reinholdt | |
| 2008/0236422 | A1 | 10/2008 | Reinholdt | |
| 2008/0314266 | A1 | 12/2008 | Reinholdt | |

FOREIGN PATENT DOCUMENTS

| | | | |
|---|---|---|---|
| DE | 1095295 | | 12/1960 |
| DE | 3047773 | A1 | 1/1982 |
| DE | 102005048467 | A1 | 4/2007 |
| DE | 102005060550 | A1 | 6/2007 |

(Continued)

OTHER PUBLICATIONS

DE Search Report for 10 2008 046 487.2 dated Mar. 9, 2009.

(Continued)

*Primary Examiner* — Leslie J Evanisko
(74) *Attorney, Agent, or Firm* — Lowe Hauptman & Ham LLP

(57) ABSTRACT

At least one printing unit which can be moved into a print-image pickup position and into a print-image transfer position fitted with a first printing pad support involving a first pad support system or first pad seat for a first printing pad and a printing plate carrier to receive a printing plate, said printing unit also including a second pad support fitted with a second support system or second pad seat for a second printing pad, the two pad supports are such that the first support system of the first pad support and the second seat or second support system of the first pad support and the second pickup or second support system of the second pad support face each other at least when in the print-image transfer position.

20 Claims, 9 Drawing Sheets

(56) References Cited

FOREIGN PATENT DOCUMENTS

| | | | |
|---|---|---|---|
| DE | 102006005073 | A1 | 8/2007 |
| EP | 0379447 | A1 | 7/1990 |
| EP | 0537649 | A1 | 4/1993 |
| GB | 804751 | | 11/1958 |
| GB | 1456016 | | 11/1976 |
| JP | 56056866 | | 5/1981 |
| JP | 63166540 | | 7/1988 |
| WO | 2008030300 | A1 | 3/2008 |

OTHER PUBLICATIONS

International Search Report for PCT/IB2009/053493 dated Nov. 9, 2009.

* cited by examiner

PAD PRINTING MACHINE

RELATED APPLICATIONS

The present application is national phase of PCT/IB2009/053493 filed Aug. 7, 2009, and claims priority from, German Application Number 10 2008 046 487.2, filed Sep. 9, 2008.

The present printing machine relates to a pad printing machine.

Pad printing machines illustratively are known from the patent documents U.S. Pat. No. 6,393,981 B1; EP 03 794 447 A1; DE 10 2005 060 55 A1; DE 10 2005 048 467 A1 and DE 10 2006 005 073 A1.

The pad printing machines known from the above disclosures serve to print a particular zone of an object either in monochrome or multichrome manner, namely in a single step monochromely or in several steps multichromely. Moreover pad printing machines also are known that illustratively print for instance dishwasher panels or washing machine panels in several printing stages.

More specifically, however, as regards printing on several sides, the state of the art requires rotating the object for instance by 90 or 180° after the first side has been printed, to proceed to printing a second or further side. Regarding circular objects which can be printed using an appropriate pad across an approximately semicircular segment, the state of the art requires rotating the object by 180° after the first side was printed to allow printing the second side and in this manner being able to apply printing to the full circumference.

Accurate positioning of the object being printed in monochrome or multichrome manner requires a specially designed object support that must adapt to corresponding changes in position and therefore entails a complex structure as well as being time-consuming, due to object repositioning. Printing two sides moreover requires the time interval of two printing cycles.

Based on the above cited state of the art, the object of the present invention is to create a printing machine of much simplified design and able to print an object on two or more sides and also all around it in minimal time.

The present invention solves this problem by a pad printing machine.

Further features of the present invention are defined in the dependent claims.

The present invention is elucidated below in illustrative manner by preferred embodiment modes shown in the appended drawings.

Figure 1:
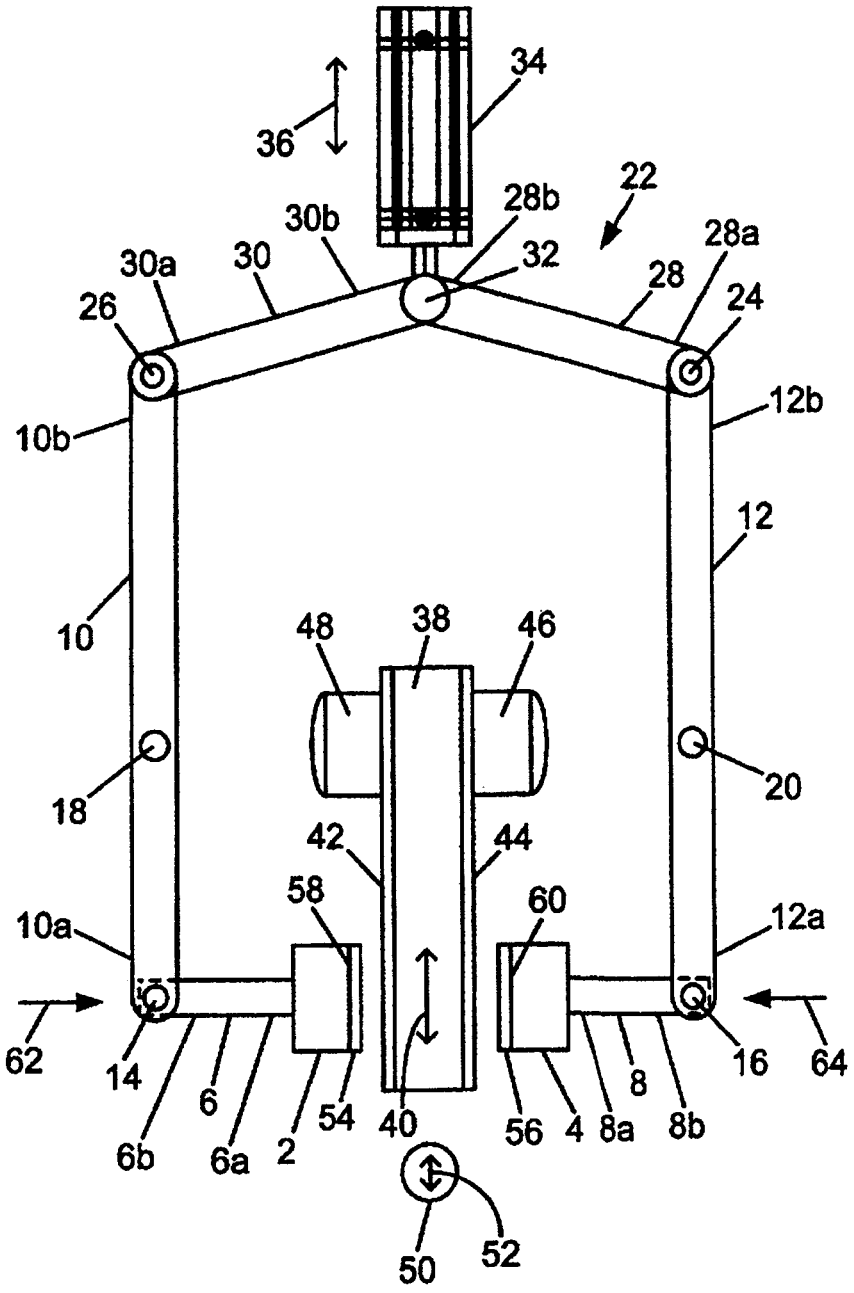
Figure 2:
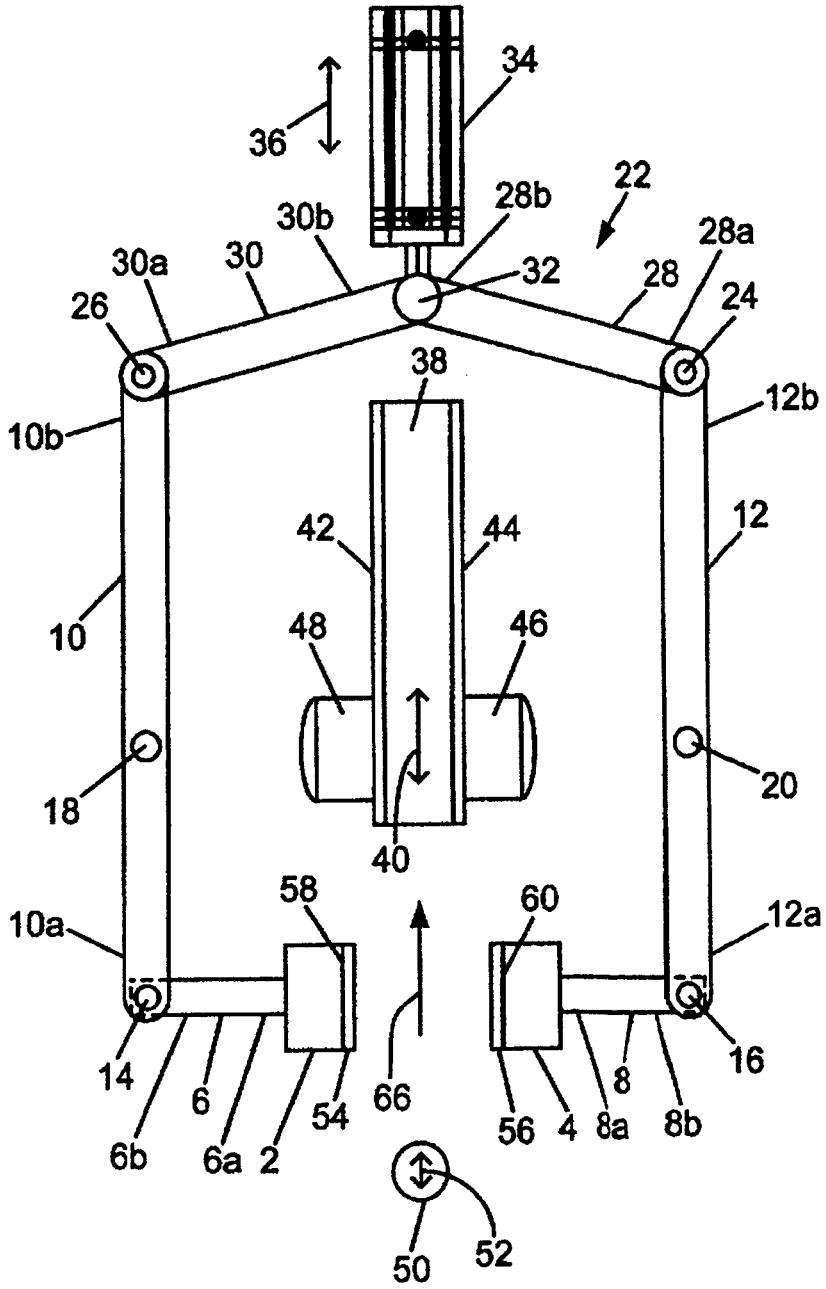
Figure 3:
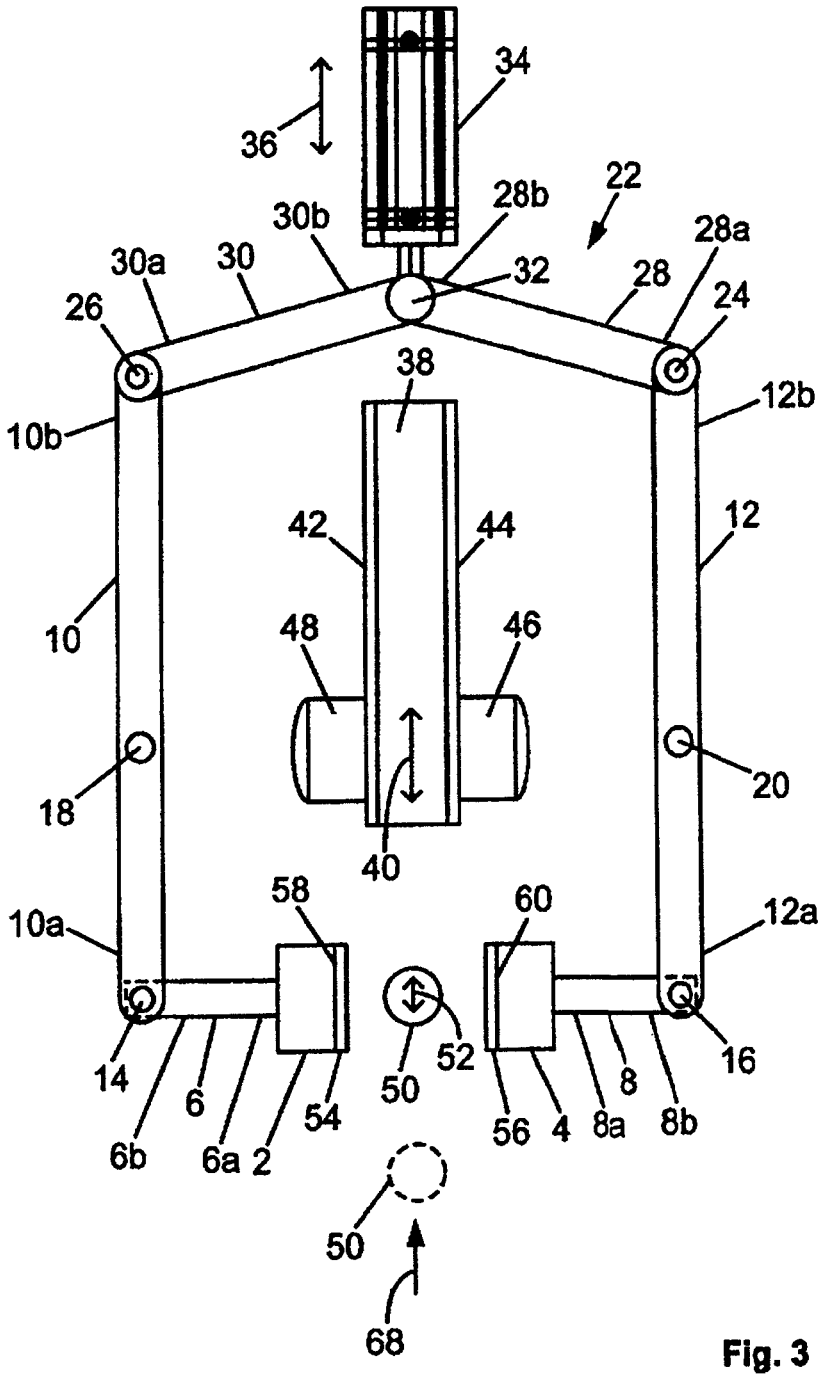
Figure 4:
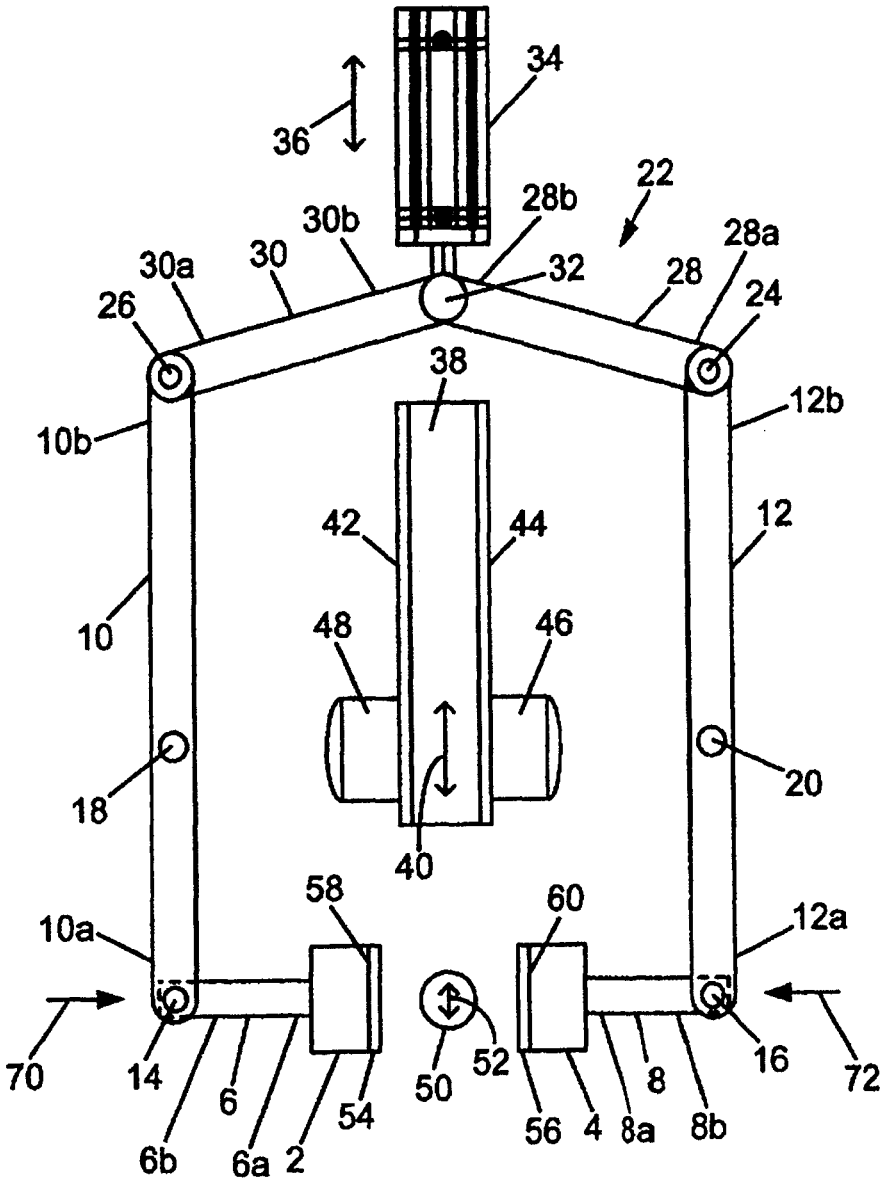
Figure 5:
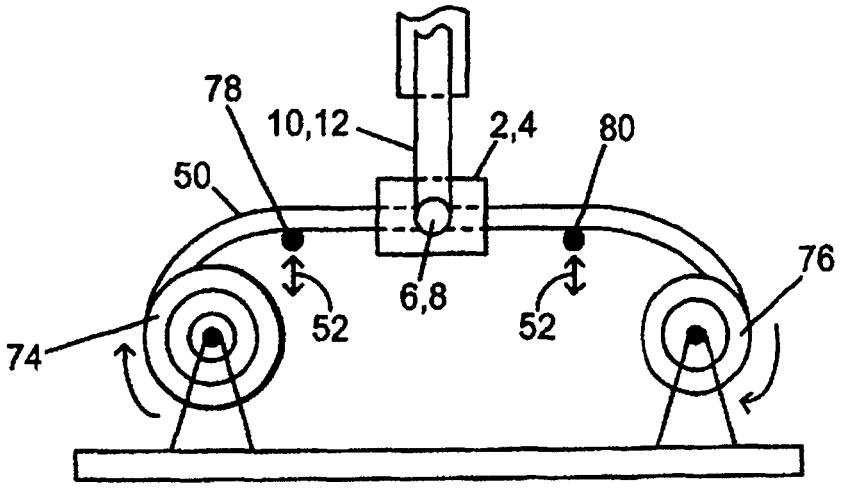
Figure 6:
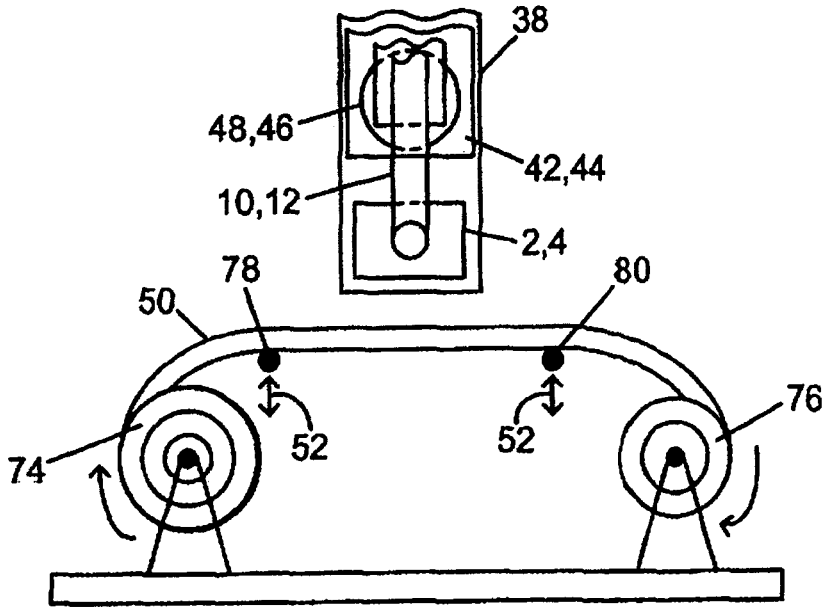
Figure 7:
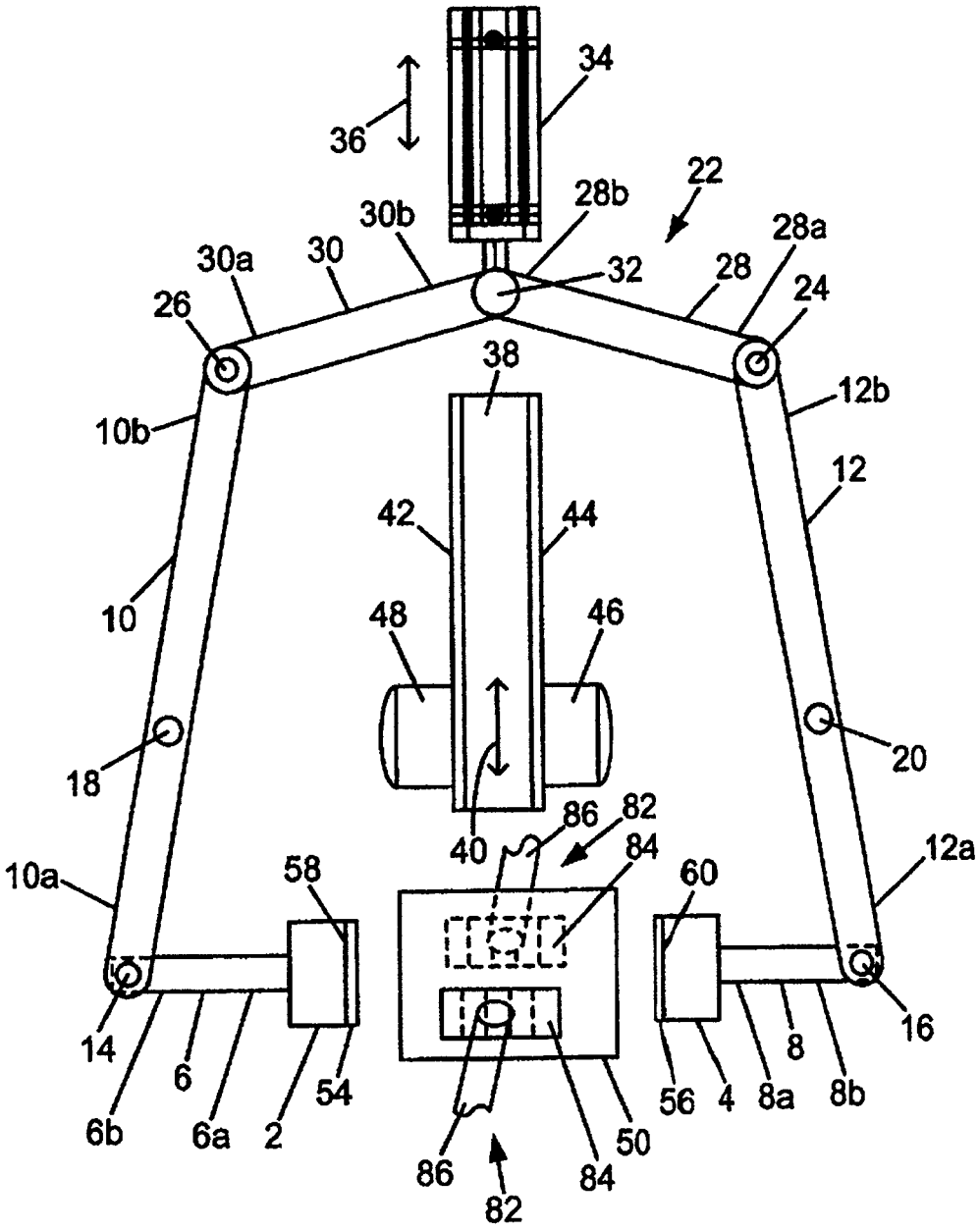
Figure 8:
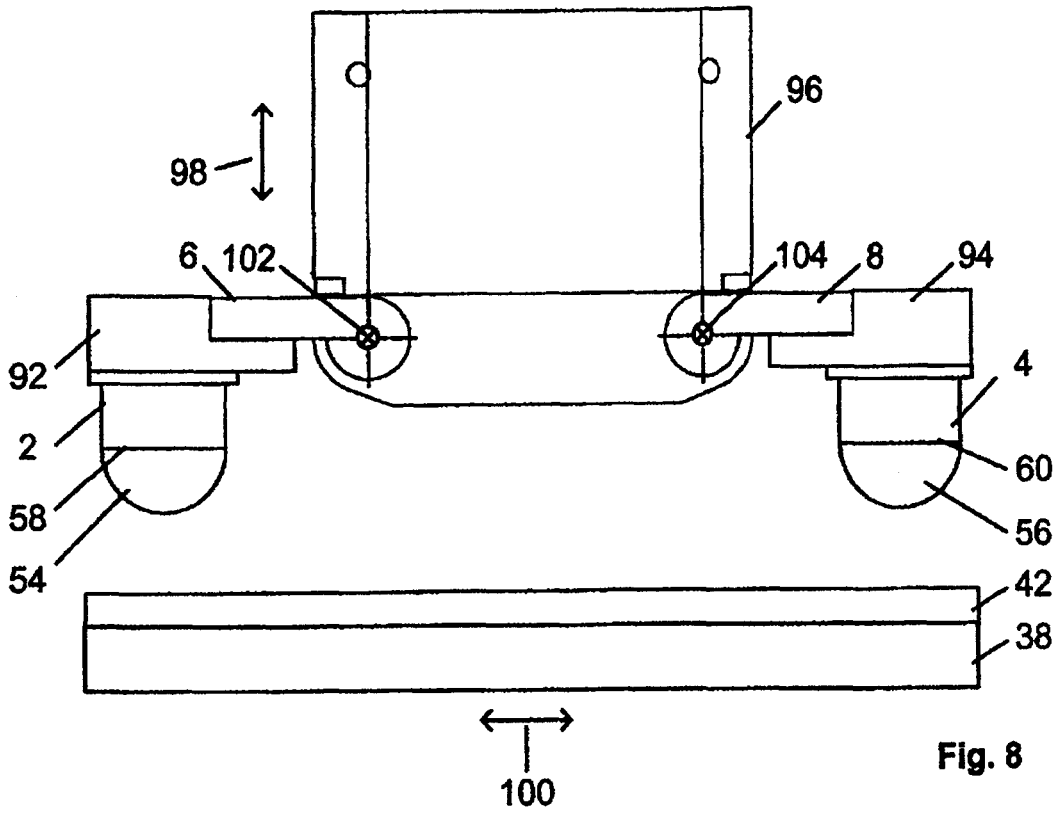
Figure 9:
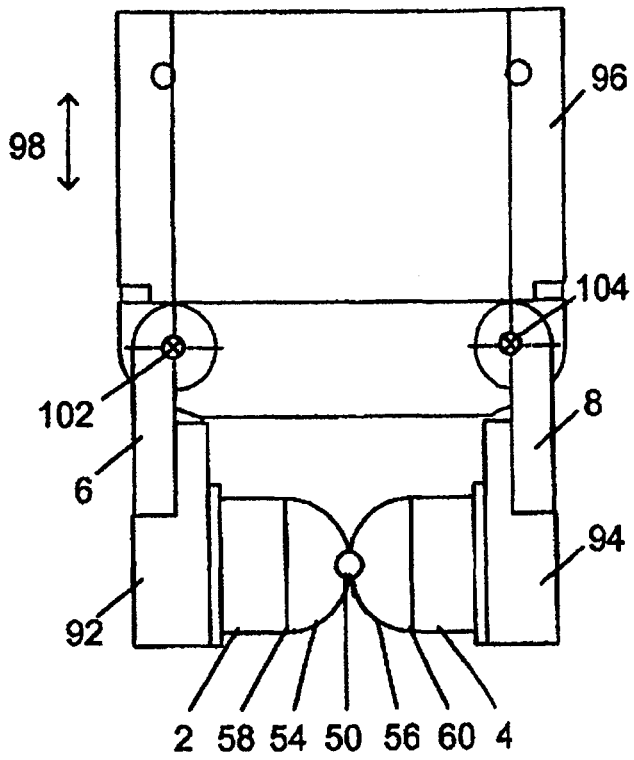
Figure 10:
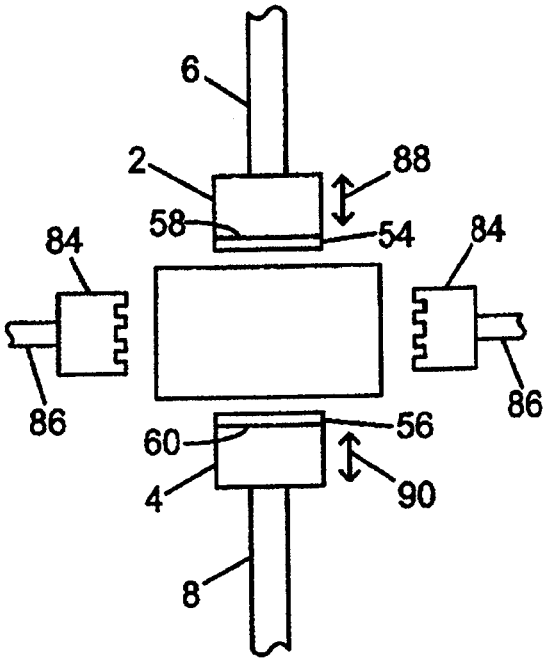

FIG. 1 is a partial view of a first embodiment mode of a printing unit of a pad printing machine of the present invention when in a position just before print image pickup, FIG. 2 is a partial view of the printing unit of FIG. 1 in an intermediate position between a print-image pickup position and a print-image transfer position, FIG. 3 is a partial view of the printing unit of FIGS. 1 and 2 in a further intermediate position, FIG. 4 is a further partial view of the printing unit of FIGS. 1 through 3 also in an intermediate position, FIG. 5 is a further partial view (side view) of the pad printing machine of the present invention of FIGS. 1 through 4 in the print-image transfer position, FIG. 6 is a view similar to that of FIG. 5 but in the print-image pickup position, FIG. 7 shows a second embodiment mode of a pad printing machine similar to FIG. 3, FIG. 8 is a partial view of a third embodiment mode of a pad printing machine of the present invention in a position shortly before print-image pickup, FIG. 9 shows the embodiment mode of FIG. 8 but in a print-image transfer position, and FIG. 10 is a partial view of a printing unit of a fourth embodiment mode of a pad printing machine of the present invention.

FIG. 1 is a partial view of a printing unit of a pad printing machine of the invention. A printing unit of the first embodiment mode comprises a first and a second pad support 2 and 4 respectively which are linked by bar-shaped or tubular connecting elements 6, 8 to actuating levers 10, 12. More specifically, the connecting elements 6, 8 are rigidly joined at one end 6*a*, 8*a* to the pad supports 2, 4 and linked at their second end 6*b*, 8*b* according to an appropriate design—namely hinge bolts 14, 16 in the shown first embodiment mode—to the actuating levers 10, 12 respectively articulating on them in a manner allowing rotation respectively pivoting about an axis of rotation respectively about a pivot axis running parallel to and concentric with the hinge bolts 14, 16.

The actuating levers 10, 12 are pivoted by hinge bolts 18, 20 about an axis perpendicular to its pertinent actuating lever, said axis in turn being parallel to and concentric with the hinge bolt 18, 20. As already mentioned above, the actuating levers 10, 12 are linked to the connecting elements 6, 8 at a particular first end 10*a*, 12*a*, namely the lower end and are linked by a particular second end 10*b*, 12*b*, namely the upper end, to first ends 28*a*, 30*a* of a toggle lever 22, again by means of hinge bolts 24, 26. The toggle lever 22 is composed of two legs 28, 30 which are linked by the hinge bolts 32 at their second ends 28*b*, 30*b* opposite the hinge bolts 24, 26, and is operationally engaged (by means of the hinge bolt 32) with a bar-shaped drive element 34 vertically displaceable, as indicated by the double arrow 36, within the pad printing machine. The drive element 34 in turn is powered in this particular embodiment mode by an electric motor and a pertinent mechanism transducing said motor's rotation into a vertical displacement of said drive element 34. Alternatively, such a drive obviously also might be pneumatic or hydraulic. All joints/links allow rotation respectively pivoting about axes parallel to and concentric with the hinge bolts.

In addition to the above discussed components, the first embodiment mode of the pad printing machine of the present invention also includes an approximately planar printing plate carrier 38 also displaceable as indicated by the double arrow 40 also in vertical manner within the pad printing machine in particular relative to the pad supports 2, 4 and the printing unit components connected to said supports. The printing plate carrier 38 is configured as a rest for a first printing plate 42 configured on the side of said carrier 38 facing the pad support 2 and to hold a second printing plate 44 resting on said printing plate carrier side facing the pad support 4.

A print image is constituted by one or more recesses in each of the surfaces of the printing plate 42, 44 that areaway from the printing plate carrier 38. Ink cups 46, 48 each fitted with a cup rim acting as a doctor scraper facing the printing plate are constituted on the print-image fitted surface of the particular printing plate 42, 44 and may be produced by etching the said plates or by other techniques.

The ink cups 46, 48 are held by magnets—which are configured internally in the present embodiment mode—on the printing plates 42, 44. For that purpose, the printing plate carrier 38 of the present embodiment mode is made of a ferromagnetic material. Alternatively the printing plate carrier 38 and the printing plates 42, 44 may all be ferromagnetic. Again, the ink cups 46, 48 may be kept mechanically, for instance by spring action, on the printing plates 42, 44, respectively being pressed against it. The ink cups 46, 48 are rigidly joined to the pad printing machine, as a result of which the printing plate carrier 38 together with the printing plates 42, 44 is displaceable relative to the ink cups 46, 48 as indicated by the double arrow 40. When the printing plate carrier 38 is moved vertically together with the printing plates 42, 44, the latter are displaced relative to said ink cups and may be moved from an "upper position" in which the print images are completely covered by the ink cups 46, 48 to a "lower position" wherein they assume the position illustratively shown in FIG. 1.

Printing pads 54, 56 are used to pick up ink (print-image pickup position) and are configured respectively affixed on the pad supports 2, 4—in this particular embodiment mode using a pad affixation system respectively pad seat 58, 60 not elucidated any further using a quick connect element—over at least part of the printing plate 42, 44 in particular synchronously respectively simultaneously to pick up ink from the print image. This procedure is indicated in FIG. 1 by the arrows 62, 64. Such a procedure reliably transfers ink from the printing plates 42, 44 to the particular printing pad 54, 56. The printing pads 54, 56 are designed to assure ink transfer from the printing plate 42, 44 to an object to be printed, (hereafter "object), when it is in its print-image pickup position underneath the printing pads 54, 56 and underneath the printing plate carrier 38 respectively the printing plates 42, 44, said object 50 also being configured in vertically displaceable manner (double arrow 52). The printing pad supports 2, 4 as well as the printing pads 54, 56 operationally engaging them are configured in a manner that they face each other. In other words, the particular pad support system respectively pad seat 58, 60 is configured at its associated pad support 2, 4 on that side at which the printing pad 54, 56 shall be situated which in each case faces the other pad support system respectively pad seat 60, 58.

FIGS. 1 through 4 show a printing cycle of the first embodiment mode of the pad printing machine of the present invention. As already discussed above, the printing plate carrier 38 of FIG. 1, which carries on its sides an etched printing plate 42, 44, is situated in a lower position wherein, following the closure indicated by the arrows 62, 64 of the "pad claws", the printing pads 54, 56 are able to pick up ink from their associated printing plates 42, 44. In the present embodiment mode, the printing plates 42, 44 are magnetic and hence are reliably affixed to the printing plate carrier 38. The pad claws being closed, the two pads 54, 56 are able to pick up ink from the printing plates 42, 44 by pressing, as already discussed above, bilaterally and preferably simultaneously against the printing plates 42, 44 as indicated by the arrows 62, 64.

After the ink has been transferred from the printing plates 42, 44 onto the printing pads 54, 56, the printing plate 38 carrier together with the printing plates 42, 44 is moved out of the region of the pads 54, 56, as indicated in FIG. 2 and by the arrow 66. For that purpose the printing plate carrier 38 is moved upward and the etched structures in the printing plates 42, 44 are replenished with ink from the ink cups 46, 48 situated above said structures and also dwelling above the print image.

After, or, alternatively also simultaneously with, the upward displacement of the printing plate carrier 38, the object 50 (FIG. 3) is moved upward between the two printing pads 54, 56 as indicated by the arrow 68. Obviously an alternative design also might be used, whereby the pads 54, 56 together with the pad supports 2, 4 and the remaining mechanism linked to same—namely the claws-shaped structure to which the pads 54, 56 are affixed—are moved downward. Changing the position of the object 50, in particular where such objects are substantially susceptible to sagging, also may be implemented in that, for the print-image pickup position of FIG. 1, such sagging object 50 is suspended past the region between the printing pads 54, 56, therefore not between them. In order to subsequently position said object between said pads, the sagging object only need then be tautened. Sagging objects 50 for instance may be cables or ropes or objects with similar properties.

The position shown in FIGS. 3 and 4 is intermediate in each case between the print-image pickup position and the print-image transfer position, the latter being the position wherein the object 50 is being printed, that is, where the printing pads 54. 56 transfer ink to the object 50. To implement such printing, the connecting elements 6, 8 together with the printing pad carriers 2, 4 and the printing pads 54, 56 joined to the position changing levers 10, 12 are moved toward the object 50 as indicated by arrows 70, 72. The "pad claws" close and in the process deliver ink to the object 50 guided between the pads 54, 56 which in the closed position encompass and hold it. In the embodiment mode under discussion, ink transfer takes place simultaneously respectively synchronously to both sides of the said object. In other words, as regards the design of the said first embodiment mode, both actuating levers 10, 12 together with the pads supports 2, 4 and the printing pads 54, 56 are simultaneously/synchronously set into motion and in that manner impact the object 50. This feature facilitates holding/handling the object 50 because allowing eliminating complex object-supporting systems and handling devices, especially as regards sagging-susceptible objects and hence may be eliminated. In this embodiment mode, the object 50 is supported/handled essentially by the printing pads 54, 56 simultaneously being applied to said object.

Alternatively, in another embodiment mode, the actuating levers 10, 12 driven in a manner that they are set in motion at different time values while nevertheless the associated printing pads 54, 56 simultaneously respectively synchronously impact the object 50 by employing different lever arm lengths in the actuating levers 10, 12, that is, different drive points.

In another alternative embodiment mode, the printing pads 54, 56 may be configured in a manner that they be at different (time) phases, i.e. that they impact the object 50 at different time values. This feature illustratively may be applied to sagging objects 50 which may be tensioned by the printing pad that first impacts said object and then continues in its motion. In this embodiment variant the pad first impacting the object 50 also may be matched in its geometry to the said objector be fitted with a recess or the like.

Be it borne in mind that the displacement of the printing plate carrier 38 of the above discussed embodiment mode is vertical in order to flood the print image with ink in simple and reliable manner, such ink always being present in the particular lower half of the corresponding ink cup 46, 48. In an alternative, another embodiment might be used, whereby the printing plate carrier 38 is configured horizontally and also does move horizontally. Such an embodiment mode is elucidated below in relation to FIGS. 8 through 10.

The displacement of the pad claws of the first above described embodiment mode may also be implemented using the centrally actuated toggle lever 22 as shown above, however it may furthermore be implemented using an arbitrarily different kind of drive such as one or more of a direct electric, pneumatic of hydraulic drive, a drive based on an adjusting or spindle motor, or other drives. On account of the ability of the printing pads 54, 56 to move simultaneously toward the object 50, respectively that these pads simultaneously make contact with said object, the latter is both maintained in place, that is its if fixed in its position and also is supported, a good support being attained thereby for sagging objects 50, together with good assurance of precluding positional shifting.

The equipment of the above described first embodiment mode is shown again in FIGS. 5 and 6 in a different view also showing the object 50 and a dispenser roll 74 and a windup roll 76 used for the object 50. FIG. 5 shows the structure in the print-image transfer position (the "claws" closed around the object 50) and FIG. 6 shows said structure in the print-image pickup position wherein—for the shown alternative of the first embodiment mode—the dispenser roll 74 and the windup roll 76 are lowered. An alternative representation might be of the print claws being moved upward and/or the object 50 being tensioned between support respective rest elements 78, 80 in the print transfer position of FIG. 5, whereas the object in the print-image pickup position of FIG. 6 is "sagging" between the support sites 70 and 80, i.e. it bulges in the downward direction. The vertical displaceability of the dispenser roll 74 and the windup roll 76 as well as of the object 50 again is indicated by double arrows 52.

FIG. 7 shows a second embodiment mode of a pad printing machine of the present invention. Its design is substantially the same as that of the first embodiment mode. In the second embodiment mode, however, the object 50 is rigid rather than susceptible to sagging—for instance it may be cylindrical like a cup, a pipe segment or the like—and shall be printed on two sides. For that purpose, and contrary to the case of the first embodiment mode comprising the dispenser roll 74 and the windup roll 76, an object support 82 is used to keep the object 50 in the desired position. This object support 82 consists of clamping jaws 84 and clamping jaw excursion elements 86 made of a soft material, preferably rubber, to move said clamping jaws toward and away from said object. In an alternative, arbitrarily different object supports may be used, illustrative picking up objects yet to be printed and situated for instance in a recess or picking them up using dowels or cylindrical pins or other such elements and holding said objects.

FIGS. 8 and 9 show a third embodiment mode of the pad printing machine of the present invention in a partial side view and in the print-image transfer position. The pad printing machine of the third embodiment mode like the previous described embodiment modes comprises two printing pads 54, 56 which again are configured respectively kept in place in pad supports 2, 4. The pad supports 2, 4 are configured respectively affixed on pad support carriers 92, 94. These pad support carriers 92, 94 again are operationally connected in compressively locked manner to the connecting elements 6, 8 that, on their side away from the pad support carriers 92, 94, are linked to a support system 96. In the embodiment being discussed, the linkage is implemented by omitted hinge bolts. Obviously any other linkage may also be used.

The support system 96 of the embodiment mode under discussion is vertically displaceable in the pad printing machine as indicated by the arrow 98. As a result (FIG. 8) the printing pads 54, 56 can be moved toward and away from the horizontally configured printing plate 42 which is mounted, again as in the previously described embodiment modes, on the printing plate carrier 38. The printing plate carrier 38 together with the printing plate 42 is horizontally displaceable as indicated by the double arrow 100, as a result of which, following ink transfer to the pads 54, 56, the printing plate 42 together with the printing plate carrier 38 can be moved horizontally, and the way is clear for the printing pads 54, 56 to the object 50.

To pick up ink, the tips, i.e. the "active" sides used for printing of the pads 54, 56 point in the direction of the horizontal printing plate 42. This also means that the pickup surfaces 58, 60 of the pad supports 2, 4 are configured horizontally. The print-image transfer position is shown in FIG. 9, and, to transfer the print image, the printing pads 54, 56 are pivoted by 90° about pivots 102, 104 running perpendicularly to the plane of the drawing, as a result of which the "active" sides of the pads 54, 56 respectively the pad support systems respectively seats 58, 60 are configured vertically. Following print-image transfer, the pads 54, 56 are pivoted back by 90° and the printing plate 42 is moved underneath the printing pads 54, 56 in order to again assume their print-image pickup position. While the printing plate 42 is displaced horizontally, it will be flooded with ink from the ink cup omitted from this drawing. Alternatively to the vertically displaceability of the support system 96 and the horizontal displaceability of the printing plate carrier 38 together with the printing plate 42, illustratively the support system 96 might be displaceable both vertically and horizontally or the printing plate 42 together with the printing plate carrier 38 shall be displaceable both horizontally and vertically, or the object 50 shall be displaceable both horizontally and vertically.

FIG. 10 shows a fourth embodiment mode of a pad printing machine of the present invention differing from the above first and second embodiment modes in that the printing pads 54, 56 and also the pad supports 2, 4 as well as the connecting elements 6, 8 are configured to be vertically displaceable as indicated by the double arrows 88, 90. In other words, objects 50 are printed simultaneously from above and below while being held in place by a corresponding supporting respectively tensioning system as described above for instance in relation to FIG. 7. In a variant of the above discussed embodiments, however, the printing plate carrier 38 is not configured vertically, but horizontally, as a result of which one of the omitted ink cups 46, 48 omitted from FIG. 8 rests on the head. The desired feed of ink may be assured for instance by applying a slight excess pressure in the pertinent ink cup 46, 48 or by similar appropriate measures (permanently keeping them filled).

Lastly, be it borne in mind in some instances, namely in the first, second and fourth embodiment modes, that a printing plate carrier 38 fitted with bilateral seats for the printing plates 42, 44, also several printing plate carriers may be used that are designed each to provide one seat to receive the printing plate. The printing pads used for the above discussed embodiment modes preferably shall be soft to very soft.

Even though the present invention was discussed above in relation to several embodiment modes exhibiting well defined feature combinations, said invention also covers further conceivable advantageous combinations such as those defined in non-restrictive manner in the dependent claims. All features disclosed in the application documents are claimed being inventive to the extent they are new over the state of the art, whether per se or in arbitrary combinations.

The invention claimed is:

1. A pad printing machine containing at least one printing unit and a drive element, said unit being displaceable by the drive element into a print-image pickup position and print-image transfer position said unit being designed to implement printing in automated steps and for that purpose being fitted with a first printing pad support comprising a first pad support system or first pad seat for a first printing pad and a printing plate carrier to receive and respectively hold a printing plate characterized in that the printing unit comprises a second pad support with a second pad support system or second seat, the two pad supports being configured in a manner that the first support system or the first seat of the first pad support and the second seat or second support system of the second pad support shall face each other at least when in the print-image transfer position, wherein the unit is displaceable, in its entirety, from the print-image pickup position to the print-image transfer position such that no part of the unit is at the print-image pickup position.

2. Pad printing machines as claimed in claim 1, characterized in that the first pad support and the second pad support synchronously respectively simultaneously may be moved into the print-image transfer position.

3. Pad printing machine as claimed in claim 1, characterized in that the printing plate carrier is designed to receive two printing plates.

4. Pad printing machine as claimed in claim 1, characterized in that the printing plate carrier is configured vertically.

5. Pad printing machine as claimed in claim 1, characterized in that the pad printing machine comprises two ink cups configured in a manner that always one end side of the ink cup faces the printing plate carrier.

6. Pad printing machine as claimed in claim 1, characterized in that the printing unit comprises two actuating levers, each of which is linked to one of the first and second pad supports.

7. Pad printing machine as claimed in claim 6, characterized in that the two actuating levers are linked to a toggle lever.

8. Pad printing machine as claimed in claim 7, characterized in that the toggle lever comprises a first and a second leg that are each linked at one of their sides to one of the two actuating levers and by their other side to the drive element.

9. Pad printing machine as claimed in claim 8, characterized in that the drive element is vertically displaceable in the pad printing machine and may be actuated/displaced by a pneumatic or electric or hydraulic drive.

10. Pad printing machine as claimed in claim 1, characterized in that the first and second pad supports are vertically displaceable in the pad printing machine.

11. Pad printing machine as claimed in claim 1, characterized in that the first and second pad supports are each configured on a pad support carriage linked directly or by means of a connecting element to the first pad support system while being pivotable about a pivot.

12. Pad printing machine as claimed in claim 11, characterized in that the pad supports are rotatable by 90° about the pivot.

13. Pad printing machine as claimed in claim 1, characterized in that the first and second pad support systems are vertically displaceable in the pad printing machine.

14. Pad printing machine as claimed in claim 1, characterized in that said machine comprises a support system for an object to be printed and being vertically displaceable relative to the printing unit within the said machine respectively being configured at said machine.

15. A device, comprising:

a pad printing machine, including:

at least one printing unit and a drive element, wherein the pad printing machine is configured such that the drive element moves the at least one printing unit to a print-image pickup position and to a print-image transfer position, the pad printing machine being configured to print in automated steps, the at least one printing unit further comprising a first printing pad support comprising a first pad support system or first pad seat for a first printing pad and a printing plate carrier to respectively hold a printing plate and a second pad support with a second pad support system or second seat, the pad printing machine being configured such that the first support system or the first seat of the first pad support and the second seat or the second support system of the second pad support face each other at least when in a print-image transfer position, wherein the pad printing machine is configured such that the at least one printing unit, in its entirety, moves from the print-image pickup position to the print-image transfer position such that no part of the unit is at the print-image pickup position.

16. The device of claim 15, wherein the printing unit comprises two actuating levers to each of which is linked, one of said first and second printing pad supports, and wherein the two actuating levers are linked to a toggle lever that comprises a first and a second leg that are each linked at one of their sides to one of the two actuating levers and by their other side to the drive element.

17. The device of claim 16, wherein the drive element is vertically displaceable in the pad printing machine.

18. The device of claim 15, wherein the first pad support system is vertically displaceable in the pad printing machine.

19. The device of claim 15, wherein the pad printing machine is configured to move the entire printing unit relative to other components of the pad printing machine in a vertical direction.

20. The device of claim 15, further including an ink cup.

* * * * *